United States Patent [19]

Yubakami et al.

[11] 4,456,669

[45] Jun. 26, 1984

[54] IMAGE FORMING PROCESS

[75] Inventors: Keiichi Yubakami, Neyagawa; Yuji Takashima, Nishinomiya; Wataru Shimotsuma, Ibaraki, all of Japan

[73] Assignee: Matsushita Electric Industrial Co., Ltd., Osaka, Japan

[21] Appl. No.: 388,732

[22] Filed: Jun. 15, 1982

[30] Foreign Application Priority Data

Jun. 16, 1981 [JP] Japan ..... 56-93328

[51] Int. Cl.[3] ..... G03C 5/00; G03G 7/00; G03G 13/14; B41L 1/20

[52] U.S. Cl. ..... 430/45; 430/47; 430/126; 430/201; 8/470; 8/471; 8/474; 346/226

[58] Field of Search ..... 430/138, 201, 45, 47, 430/291, 126; 282/27.5; 8/470, 471, 474

[56] References Cited

U.S. PATENT DOCUMENTS 3,386,379 6/1968 Gundlach et al. ..... 8/471
3,502,871 3/1970 Marx et al. ..... 430/201
4,124,384 11/1978 Centa ..... 430/201
4,262,078 4/1981 Ishida et al. ..... 430/126
4,294,902 10/1981 Takashima et al. ..... 430/47

*Primary Examiner*—Richard L. Schilling
*Attorney, Agent, or Firm*—Wenderoth, Lind & Ponack

[57] ABSTRACT

An image forming process comprising steps of arranging on a support member, in accordance with image signals, image forming particles containing dye former which develops its color in reaction with a color developing agent, heat-transferring the dye former from the particles to an image receiving substrate. After the heat-transfer step, the color developing agent is caused to adhere to the dye former heat-transferred on the image receiving substrate to provide colored images.

Choice of the image receiving substrate and the color developing agent is expanded. Fogging is not caused, color purity is not lowered, and the other image receiving material is not polluted due to reevaporation of the dye former which is on the image receiving substrate and is not reacted with color developing agent.

10 Claims, 15 Drawing Figures

IMAGE FORMING PROCESS

BACKGROUND OF THE INVENTION

1. Field of the Invention

The present invention relates to an image forming process comprising steps of heating image forming particles containing a dye former arranged in accordance with a color signal, thereby heat-transferring the dye former onto an image receiving substrate, thereafter causing a color developing agent to adhere onto the heat-transferred dye former to provide color images.

2. Description of the Prior Art

Conventionally, in addition to one shot color image forming method described in, for example, U.S. Pat. No. 4,294,902, by which color images can be obtained only through one exposure stage and only one development stage, various proposals have been made as an image forming method in this field.

However, in the conventional image forming method, an image receiving substrate initially containing the color developing agent of dye former has been used. Thus, plain paper, which is a commonly available office supply, could not be employed as an image receiving substrate. Also, the dye former is colorless or light in color in its ordinary state. The dye former was vaporized through heating to react with the color developing agent to develop a color. After the color development, the dye former was not vaporized, while an acid material was provided as the color developing agent.

However, to heat-transfer the dye former, the heating at 120° through 250° C. was required. When an image receiving substrate containing the color developing agent of the conventional art was used, it was required to choose a color developing agent, which was not changed in quality or was not deteriorated even at the heating temperatures of the heat-transfer operation. Thus, the color developing agent was restricted.

Namely, on the assumption that a plain paper, which was impregnated with color developing agent such as tartanic acid, DL-mandelic acid, O-benzoylbenzoic acid or the like, was used as an image receiving substrate, the color developing agent was dissolved due to the heat of the heat transfer to cause the image forming particles to adhere to the image receiving substrate, thereby to decrease the color purity of the colored image. When the image receiving substrate was left for a longer period of time, the color developing agent was heat-transferred or evaporated, which made it difficult to be developed.

Moreover, according to the conventional image forming process, the dye former was permeated into the image receiving substrate in the heat-transfer process of the dye former. The dye former was heated until it reacted with the color developing agent, and was developed. Thus, more heat was required than was necessary for heat-transfer of the dye former.

Accordingly, for example, active clay was provided as a heat resisting color developing agent. Thus, so-called clay paper, wherein the active clay was applied upon the base paper, was used. Although the color developing mechanism of the dye former and the active clay is not clear, it was found through experiments that after the dye former has been brought into contact with the active clay, which contains moisture of approximately 2% or more by weight, the heating is performed for color development. Accordingly, to use the clay paper as an image receiving substrate, the quantity of heat for vaporizing the dye former from the image forming particles and the quantity of heat for color development are required. Thus, a heater with a larger quantity of heat was required to be used or the heating period was required to be rendered longer.

Referring to FIG. 1, when a dye former 4 is heat transferred from the image forming particles, onto the conventional image receiving substrate 3 having a color developing agent layer 2 containing the color developing agent 1, the dye former 4 permeates into the layer 2 to develop a color as in particles 5 to provide a colored image 6. In the conventional art, excessively vaporized dye former 4 remained on the image receiving substrate 3 as it was, on the colored image 6 as shown in FIG. 1. The excessive undeveloped dye former 4 was re-evaporated due to time passing or when it was left in a high temperature atmosphere. The dye former was spread to the other portions as in "a" in the drawing to cause fogging or decrease in the color purity. Also, the dye former was spread to the other image receiving substrate as shown in "b" of the drawing to cause pollution.

SUMMARY OF THE INVENTION

An object of the present invention is to provide an image forming process which is capable of removing the conventional problems and providing superior colored images.

Another object of the present invention is to provide an image forming process capable of expanding the choice of the image receiving substrate and the color developing agent, and settling the problems of causing fogging, decreasing the color purity and producing the pollution of the other image receiving materials.

The above-described objects are achieved by heat-transferring the dye former contained in the image forming particles, onto the image receiving substrate, thereafter causing the color developing agent to adhere to the dye former heat-transferred on the image receiving substrate to develop the color.

The other objects, features, aspects, and advantages of the present invention will become more apparent from the following detailed description of the present invention when taken in conjunction with the accompanying drawings.

DESCRIPTION OF THE PREFERRED EMBODIMENTS

The image forming process of the present invention will be described hereinafter with reference to the drawings.

Figure 1:
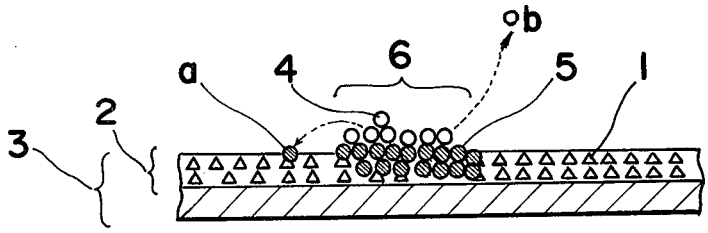
FIG. 1 is a schematic diagram for illustrating the problems of the conventional image forming process as referred above.
Figure 2:
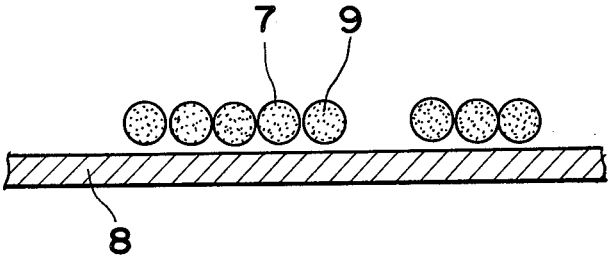
FIG. 2 is a cross-sectional view for illustrating the particle image on a support member 8 on which image forming particles 7 are arranged in accordance with image signals in connection with the image forming process of the present invention.

FIG. 2 shows how image forming particles 7 containing dye former 9 are arranged on a support member 8 in accordance with image signals in connection with the image forming process of the present invention. A method of arranging the particles 7 on the support member 8 in accordance with image signals may be an ordinary method such as a method of causing the particles to electrostatically adhere to latent images formed by charging dielectric member in accordance with image signals by an electrostatic pin, a method of causing the particles electrostatically adhere to latent images formed by an electrophotographic process or the other method. Thus, the arranging method is not restricted in any particular way.

Figure 3:
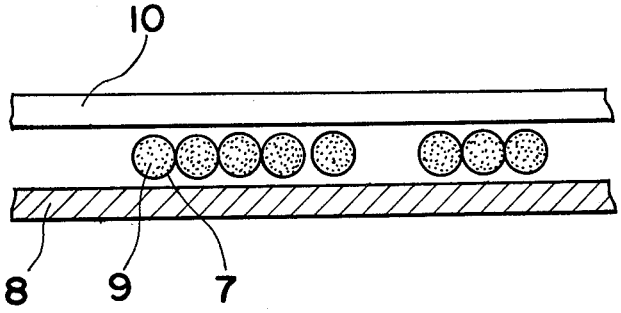
FIG. 3 is a cross-sectional view for illustrating how the image receiving substrate 10 adheres on the particle image on the support member.
Figure 4:
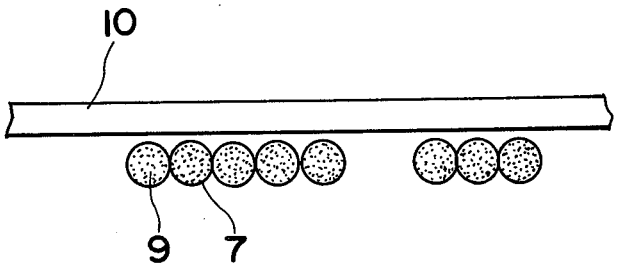
FIG. 4 is a cross-sectional view for illustrating the particle image on the image receiving substrate 10 on which the image forming particles 7 are transferred.

FIG. 3 shows the state where an image receiving substrate 10 closely adheres to the particles 7 arranged on the support member 8. The heat-transfer process may be performed by heating under the conditions of FIG. 3. Also, the heat-transfer process may be performed after the particles 7 have been transferred onto the image receiving substrate 10 by an ordinary method, for example, the particles 7 are transferred through the application of the voltage from the reverse face of the image receiving substrate 10, as shown in FIG. 4. Or when the support member 8 serves as the image receiving substrate, the heat-transfer process is performed under the condition of FIG. 2.

Figure 5:
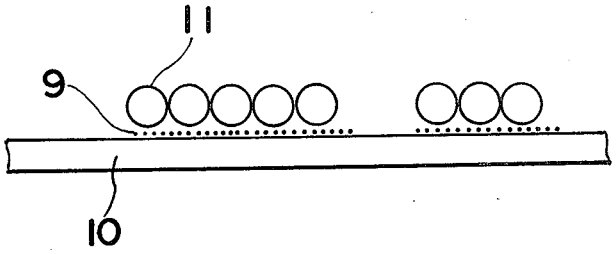
FIG. 5 is a cross-sectional view for illustrating how dye former 9 is vaporized and transferred onto the image receiving substrate 10.

FIG. 5 shows a condition where the particles 7 are heated to go through the heat-transfer process under the condition of FIG. 4. It is to be noted that particles with the dye former 9 being vaporized are designated with reference numeral 11 in FIG. 5.

Figure 6:
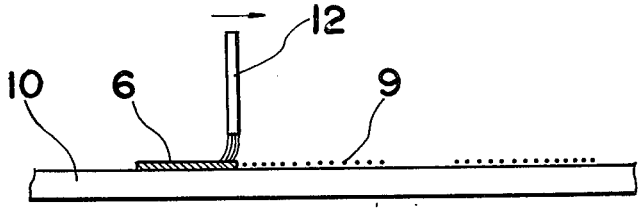
FIG. 6 is a cross-sectional view for illustrating one example of the color developing process of the image forming process of the present invention.
Figure 7:
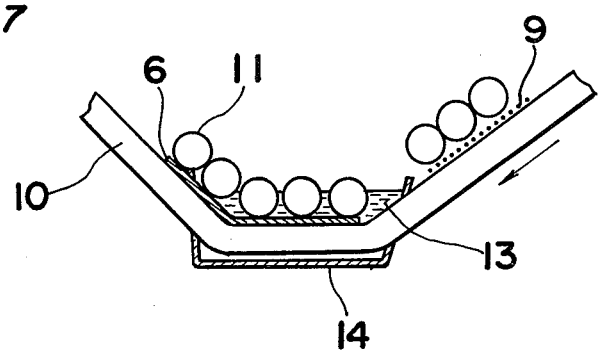
FIG. 7 is a cross-sectional view for illustrating the other example of the color developing process of the image forming process of the present invention.

The image receiving substrate 10 has no color developing agent of the dye former 9. Accordingly, the dye former 9 is not developed in FIG. 5. To provide colored images on the image receiving substrate 10, it is required to cause the color developing agent to adhere to the former 9. A method of causing the color developing agent to adhere thereto may be a method of dipping in solution containing the color developing agent or an ordinary means of vaporizing the color developing agent. As one example of providing the colored images, FIG. 6 shows a method of cleaning the particles 10 by an ordinary means, and thereafter, color-developing the dye former 9 by a brush 12 dipped in solution containing the color developing agent to provide the colored images 6. Also, as shown in FIG. 7, as the other example, there is a method of dipping an image receiving substrate 10 in a plate 14, with the color developing agent containing solution 13 being provided therein, to color-develop the dye former 9 to provide the colored images 6, and thereafter, cleaning the particles 11.

Materials to be used in the present invention will be described hereinafter. The image forming particles to be used in the present invention basically includes at least resin and dye former. The resin may be a resin, which does not show acidity such as polyvinyl alcohol, acrylic resin, melamine resin, styrene-butadiene copolymer or the like. Also, additive such as heat resisting agent, surface active agent of dye former or the like may be blended with the resin for use.

For the support member to be used in the present invention, there can be used a dielectric material such as vinyl acetate resin, vinyl chloride resin, silicone resin or the like, or ordinary electrostatic recording paper and a photoconductive member for electrophotographic use wherein zinc oxide, cadmium sulfide, poly-N-vinyl carbazole, selenium or the like is singly applied or evaporated on the conductive support member or applied together with proper binding agent thereto.

Also, the dye former is the colorless sublimable dye, which is colorless or light in color under ordinary conditions, is vaporized, when heated, for reaction with the color developing agent so as to develop the color and is not vaporized after the color development. The representative example of the dye formers are 3,7-bis-diethylamino-10 trichloroacetyl-phenoxazine, 4-(1,3,3,5-tetramethyl-indolino)methyl-7-(N-methyl-N-phenyl-)amino-1',3',3',5'-tetramethyl-spiro[2H-1-benzopyran-2,2'-[2'H]-indole], N-(1,2-dimethyl-3-yl)-methylidene-2,4-dimethoxy aniline.

The color developing agent is an acid material. The representative examples of the color developing agent are fatty acids such as acetic acid, tartaric acid, D-benzoyl benzoic acid, fumaric acid, trichloroacetic acid, citric acid, D,L-mandelic acid, behenic acid or the like; cyclic acids such as ascorbic acid, phenyl acetic acid, salicylic acid, 5-chlorosalicylic acid or the like; phenolic acids such as 2,2-bis(4'-oxyphenyl)propane or the like. In addition to such organic acids as described hereinabove, inorganics such as active clay, silicon dioxide or the like, or iodine gas can be used. Also acid polymers such as polyparaphenyl phenol or the like can be used.

As the material for the image receiving substrate, there is, in addition to plain paper, electrostatic recording paper and glass, there are enumerated high molecular films such as polyethylene, polypropylene, polyethylene terephthalate, or the like and the support member substrate or the like.

Also, the images by the image forming process of the present invention are the color images of the dye former which are contained in the image forming particles. Namely, they are different from toner images provided by the ordinary electrophotography or the like. According to the image forming method of the present invention, sufficiently high print density can be provided even if the image forming particles adhere in one layer, onto the image receiving substrate or the support member according to the image signals during the heat-transfer step of the dye former. When the image forming particles adhere in one layer as described hereinabove, the consumption quantity of the image forming particles becomes at least half or less as much. To cause the image forming particles to adhere in one layer, the image forming particles are desired to be conductive. As conductive agents, which give conductivity to the image forming particles, there are carbon, polyelectrolyte, copper iodide or the like. The conductive agent may be kneaded with the image forming particle material or be caused to adhere onto the particle surfaces to perform the conductive operation. The specific resistivity at this time is desired to stay within the range of 10 through $10^{10}\Omega$.cm. The difference in the specific resistivity between the particles is desired to be arranged in one unit or less within the range of the value of the specific resistivity.

It is to be noted that, although the material as described hereinabove is provided to facilitate the understanding of the embodiment of the present invention, the material to be applied to the process of the present invention is not restricted to the above-described example, and does not impose a restriction upon the process of the present invention.

The process for forming the images in accordance with the present invention will be specifically described hereinafter.

According to the image forming process of the present invention, the image forming particles containing the dye former are arranged on the support member in accordance with the image signal. The particles are heated to heat-transfer the dye former onto the image receiving substrate to cause the color developing agent to adhere to the dye former heat-transferred to provide the color images. Namely, the color of the color image is the color provided after the color development of the dye former to be contained in the image forming particles. Accordingly, a monochrome image is used with the use of one type of image forming particles only. To provide multi-color images, the description is broadly divided into two image forming processes as will be described hereinafter, and image forming particles of two types or more are used.

(i) Method of repeating heat-transfer step a plurality of times

According to image signals in which the manuscript has been color-separated by a first color separation filter, image forming particles containing dye former, which color-develops to a complementary color with respect to the color of the first color separation filter, are arranged on the support member. The particles are heated to heat-transfer the dye former onto the image receiving substrate. Thereafter, according to the image signals in which the manuscript has been color-separated by a second color separation filter, image forming particles containing dye former, which color-develops to a complementary color with respect to the color of the second color separation filter, are arranged on the support member. The particles are heated to heat-transfer the dye former onto the image receiving substrate. After repetition of such process, the color developing agent is reacted with the dye former heat-transferred on the image receiving substrate to provide color images.

The method according to the present invention generally described so far will be explained more specifically hereinbelow, with reference to a case in which red (R), green (G) or blue (B) is used for the color separation filter and color after the color development of the dye former is of cyan (C), magenta (M) or yellow (Y) while electrostatic recording paper is used for the support member and image receiving substrate. Electrostatic latent images are formed on the electrostatic record paper by an electrostatic pin in accordance with the image signals wherein the manuscript has been color-separated by the (R) filter. The image forming particles containing the (C) color-developing dye former are caused to electrostatically adhere onto the electrostatic record paper in accordance with the latent images, and are heated to heat-transfer the dye former onto the electrostatic record paper. Thereafter, the image forming particles are removed from the image forming substrate for erasing the electrostatic latent images by an AC corona or the like. A similar process is performed on the same electrostatic recording paper by the use of the image forming particles containing the (M) color-developing dye former with respect to the (G) filter and by the use of the image forming particles containing the (Y) color-developing dye former with respect to the (B) filter. Thereafter, color developing agent is caused to adhere onto the dye former which is heat-transferred to provide the colored images. As a method of causing each of the image forming particles to electrostatically adhere to the electrostatic record paper in the above-described process, a toner developing method, which is normally used in the electrophotography or the like, is used.

(ii) Method of performing heat-transfer step by one process

This is a method which employs color image forming particles prepared by mixing a plurality of kinds of image forming particles of light transmitting nature having a color separation function and containing the dye former which develops a color complementary to the color of the color separation filter, and a panchromatic photoconductive member as a support member. The image forming particles for color use are uniformly spread into one layer on the uniformly charged photoconductive member for exposure through the color image forming particles. Thereafter, upon subjecting, for example, the electrophotographic photoconductive member, to a slight vibration, the light transmitted particles whose electrostatic attraction with respect to the photoconductive member is weakened, are shaken off, and thus, particle image subjected to color separation is obtained on said conductive member. The image forming particles forming the particle image are heated to heat-transfer the dye former onto the image receiving material, and thereafter the color developing agent is caused to adhere to the dye former heat-transferred to develop the color.

In the method of performing heat-transfer step by one process, a method similar to a process described in the item (i) can be performed. Namely, the image forming particles containing the dye former, which develops color complementary to the color of the color separation filter are arranged on the support member in accordance with the image signals wherein the manuscript was color-separated, and said particles are transferred onto the image receiving substrate. Subsequently, the image forming particles containing the dye former which develops the color complementary to the color of the color separation filter are arranged on the support member in accordance with the image signals wherein the manuscript has been color-separated by the other color separation filter, and the particles are positioned on the image receiving substrate to perform the transfer. Such a process as described hereinabove being repeated, the particles transferred onto the image receiving substrate are heated to heat-transfer the dye former onto the image receiving substrate, and thereafter, the colored images may be obtained through adhesion thereto of the color developing agent.

It is to be noted that the above-described example is given merely for better understanding, without any intention of limiting the scope thereof.

The characteristics and effect of the image forming method of the present invention will be described hereinafter.

Figure 8:
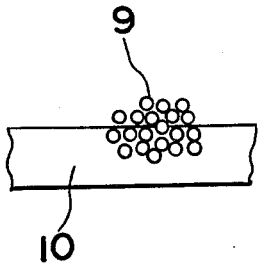
FIGS. 8 and 9 are cross-sectional views each illustrating the characteristics of the image forming process of the present invention.
Figure 9:
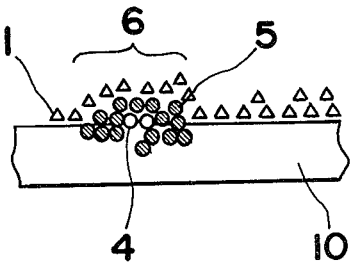

FIG. 8 shows how the particles are removed for cleaning after the heat-transfer step of the image forming method of the present invention. One portion of the dye former 9 is permeated through the layer of the image receiving substrate 10 and the other portion of the dye former 9 is located on the image receiving substrate 10. As the color developing agent 1 adheres as shown in FIG. 9, most of the dye former 9 is colored as shown at 5. However, the partially unreacted dye former 4 remains. Also, since the unreacted dye former is covered by the color developing agent 1, the unreacted dye former 4 does not go out of the range of the colored image 6. Accordingly, the resultant colored images are free from generation of fogging, reduction in color purity or soiling of other image receiving substrates through re-vaporization of the dye former 4 due to standing in a high temperature atmosphere or lapse of time, and therefore, there is an advantage such that the image quality is stable against deterioration for a long period of time.

Furthermore, although, in the conventional image forming methods, it is necessary to employ an image receiving substrate preliminarily provided with a color developing agent, according to the present invention, a wide selection of materials for image receiving substrates is possible, since the color developing agent is caused to adhere after the vaporizing process. Therefore, plain paper which is mainly used for office, glass, macro-molecular films or the like, can be adapted as the image receiving substrate.

Moreover, there has been a problem such that, the conventional image receiving substrate, if left as it is for a long period of time, tends to lose its performance for developing color due to evaporation of the color developing agent.

According to the image forming process of the present invention, the color development can be always performed in the same condition, since the color developing agent is caused to adhere to the dye former after the heat-transfer of the dye former. Even if the color developing agent is sublimated or evaporated after the color development, the color-developing dye former is not discharged or reevaporated. Accordingly, the colored image is not changed.

According to the image forming process of the present invention, the color developing agent is caused to adhere to the dye former after the heat-transfer of said dye former. Namely, the color developing agent is not heated in the heat-transfer step. Therefore, even a color developing agent, which is inferior in the heat resisting property, may be applied, and thus, the range of choice of the color developing agent substrate can be extended.

Moreover, according to the present invention, all that is necessary is to apply the quantity of heat necessary for heat-transfer of the dye former. Therefore, in the image forming method of the present invention, the quantity of heat during the heating can be reduced to one tenth or less of the conventional process. Thus, the power consumption of the heater may be markedly reduced.

As described hereinabove, the present invention provides an image forming process, which is extremely effective and useful.

Hereinbelow, specific Embodiments are inserted for the purpose of illustrating the present invention without any intention of limiting the scope thereof.

EMBODIMENT 1

Image forming particles were prepared in accordance with the following prescription.

| Substances | Parts by weight |
|---|---|
| *Styrene-butadiene copolymer: DAN BOND (manufactured by NIPPON ZEON Co., Ltd. of Japan) | 100 |
| *Colloidal Silica: SNOWTEX ST-20 (manufactured by NISSAN Chemical Industries, Ltd. of Japan) | 50 |
| *Water | 250 |
| *Carbon: CONDUCTEX SC (manufactured by Columbian Carbon Japan Ltd. of Japan) | 40 |
| *Magenta color-developing dye former 4-(5-chloro-1,3,3-trimethyl-indolino) methyl-7-(N—methyl-N—phenyl)amino-5'-chloro-1',3',3'-trimethyl-spiro[2H—1-benzopyran-[2H]-indole] | 5 |

The following compositions were crushed and spread for two hours by a ball mill and thereafter, were granulated by a spray-dry apparatus, thus resulting in particles having average particle diameter of 15 μm and specific resistivity in the order of $10^3\Omega$cm. Images were formed by the following method with the use of the above-described particles.

Figure 10:
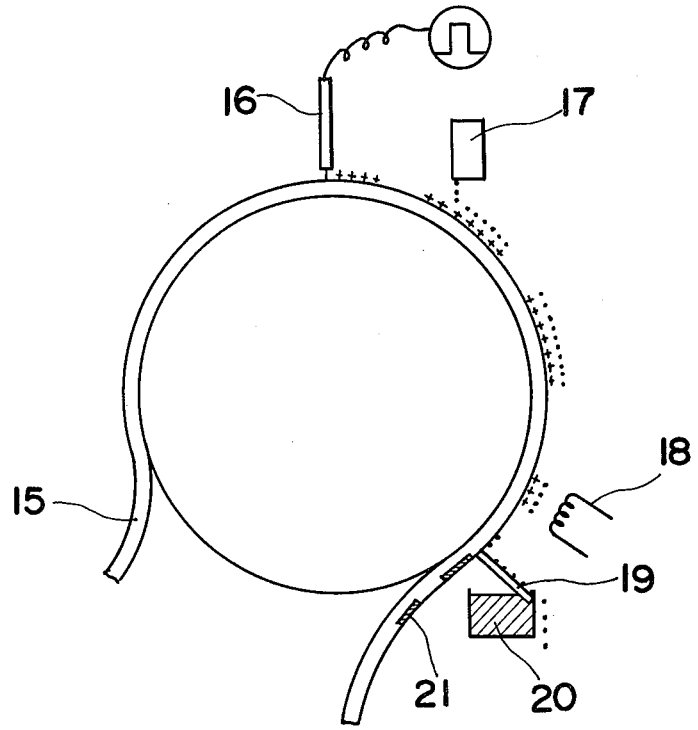
FIG. 10 is a cross-sectional view for illustrating one example of the embodiment of the present invention.

As shown in FIG. 10, an electrostatic recording paper 15 available on the market was charged, in accordance with the image signals, by the electrostatic pin 16 applied with a voltage at +3 KV. The above-described particles were electrostatically attracted onto the electrostatic latent images by a developing apparatus 17. It was heated, by a heater 18, for 0.5 second at 170° C. to evaporate the dye former contained in the image forming particles as described above. The particles were removed for cleaning by a felt blade 19 soaked with a solution from a tank 20 containing the 1% by weight methyl alcohol solution of tartaric acid, and upon development in color, clear images 21 of magenta color were obtained. The image 21 was approximately 1.9 in highest density, and the base density was approximately 0.1.

EMBODIMENT 2

A solution, 50 parts by weight, composed of dye former which develops a cyan color (3,7-bis-diethylamino-10-trichloroacetyl-phenoxazine) 10 parts by weight, ethyl cellulose (a binding agent) 1 part by weight and dichloroethane (a solvent) 89 parts by weight, was added to glass beads (15 μm in average particle diameter) 50 parts by weight, and was mixed therewith by a rotation-agitation method for drying. Then the dye former was coated on the surface of the glass beads, thus producing colorless transparent image forming particles. Meanwhile, a 5% by weight tetrahydrofuran solution of poly-N-vinyl carbazole (hereinafter referred to as PVK) is cast on nesa-glass to provide the PVK photoconductive member of approximately 20 μm in thickness.

Figure 11:
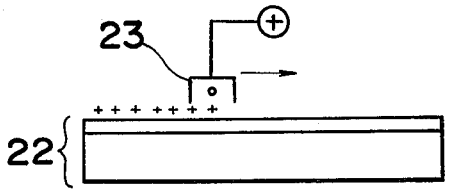
FIG. 11 through FIG. 15 are cross-sectional views for illustrating the other embodiment of the present invention, respectively, FIG. 11 illustrating the charging process thereof, FIG. 12 illustrating the spreading process, FIG. 13 illustrating the image exposing process, FIG. 14 illustrating the developing process, and FIG. 15 illustrating the color developing process.
Figure 12:
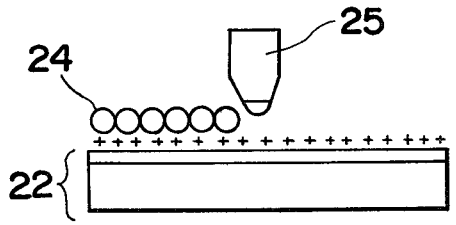
Figure 13:
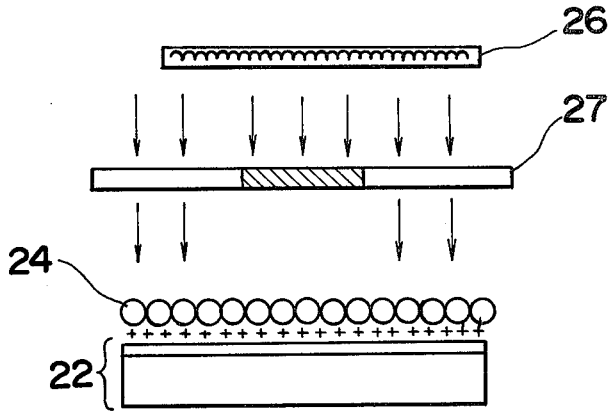
Figure 14:
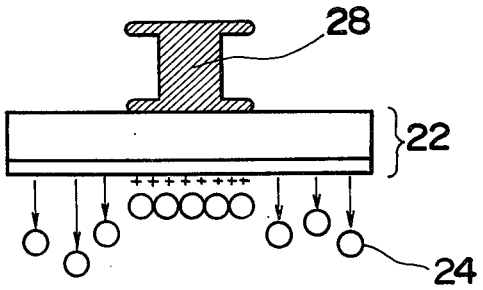
Figure 15:
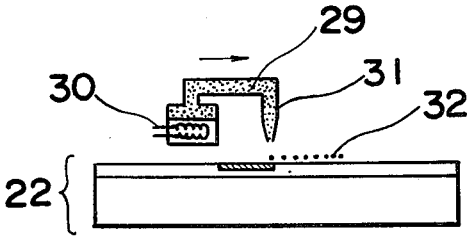

As shown in FIG. 11, the above-described PVK photoconductive member 23 was uniformly charged in darkness by a corona charger 23 applied with a voltage of +6 KV. As shown in FIG. 12, the above-described particles 24 were spread by a spreading apparatus 25. As shown in FIG. 13, the manuscript 27 was image-exposed, with a mercury lamp 26 through particles 24. As shown in FIG. 14, the particles at the exposed portion were removed, upon application of vibration by a trembler 28 after the image exposure, and the particle images were developed. Thereafter, the particles were heated at 170° C. for 0.5 seconds to evaporate the dye former, thereby to clean the particles. Then, color developing agent 5-chloro salicylic acid 29 was heated by the heater 30 as shown in FIG. 15 and was sprayed from the nozzle 31. The dye former 32 was color-developed to present a clear cyan color, thus producing the transparent type of images of cyan color. The transmittance of the highest density portion of the image was approximately 2.5% in visual transmittance as illuminant C and was approximately 75% in the base portion.

EMBODIMENT 3

The mixture of the following prescription was granulated by a spray-dry apparatus, thus producing the particles A with average particle diameter of 20 μm.

| Substances | Parts by weight |
|---|---|
| *Melamine: Sumitex Resin M-3 (name used in trade and manufactured by the Sumitomo Chemical Co., Ltd. of Japan) | 100 |
| *Curing accelerator: Sumitex Accelerator EPX (name used in trade and manufactured by the Sumitomo Chemical Co., Ltd. of Japan) | 80 |
| *Magnetite: EPT-500 (name used in trade and manufactured by Toda Kogyo Corp. of Japan) | 80 |
| *Water | 100 |

The dye former was coated in fluid state separately on the particles A, in accordance with the following prescription.

(1) Cyan color-developing particles

A solution 50 parts by weight composed of dye former which develops a cyan color (3,7-bis-diethylamino-10-trichloroacetyl-phenoxazine) 10 parts by weight, ethyl cellulose (a binding agent) 1 part by weight and dichloroethane (a solvent) 89 parts by weight are coated in fluid state with respect to particles A 100 parts by weight.

(2) Magenta color-developed particles

A solution 15 parts by weight composed of magenta color-developed dye former 4-(5-chloro-1,3,3-trimethyl-indolino)methyl-7-(N-methyl-N-phenyl)amino-5'-chloro-1',3',3'-trimethyl-spiro[2H-1-benzopyran-[2H]-indole] 10 parts by weight, ethyl cellulose 1 part by weight and dischloroethane 89 parts by weight is coated in fluid state with respect to the particles A 100 parts by weight.

(3) Yellow color-developing particles

A solution 50 parts by weight composed of yellow color-developed dye former N-(1,2-dimethyl-3-yl)-methylidene-2,4-dimethoxy aniline 10 parts by weight, ethyl cellulose 1 part by weight and dichloroethane 89 parts by weight is coated in fluid state with respect to particles A 100 parts by weight.

Three-time exposures, three-time developments, three-time heat-transfers to be described hereinafter reproduced color images by the use of the image forming particles thus produced.

As a photoconductive support member, a panchromatic cadmium sulfide (CdS) was used.

As the image forming process, the photoconductive support member was first negatively charged by a corona charger to a potential of −6 KV through −7 KV in a dark location, and the document was illuminated for about 0.5 second through a color separation filter of Kodak Wratten filter No. 25 with 300 W tungsten lamp as a light source. Thereafter, the cyan color-developed particles were caused to electrostatically adhere to the photoconductive support member by a magnetic brush developing method. Then, after removing operation was performed by the AC corona, bond paper was caused to adhere to the particles. The particles were transferred on the bond paper, from the reverse face of the bond paper by a corona charger applied to a potential at +6 KV. It was heated at 180° C. for 0.4 seconds. The dye former was evaporated and impregnated in the bond paper and the particles on the bond paper were removed by a cleaning brush. Then, the photosensitive member was charged in the same process. The same manuscript was illuminated for about 0.5 seconds, through color separation filter of Kodak Wratten No. 57. The magnet color developed particles were electrostatically adhered by the same manner. Similarly, the positioning operation was performed on the same bond paper for transfer operation. It was heated at 180° C. for 0.4 seconds. The dye former was evaporated and impregnated in the bond paper and the particles were removed. The same manuscript was illuminated for about 0.5 seconds through a color separation filter of Kodak Wratten filter No. 47B. The yellow color-developed particles were electrostatically adhered in the similar manner. Similarly, the positioning was effected on the same bond paper to perform the transfer. It was heated at 180° C. for 0.4 seconds. The dye former was evaporated and impregnated in the bond paper and the particles were removed for cleaning. Thereafter, the bond paper was dipped in an acetone solution (10 wt%) of 2,2-bis(4'-oxyphenyl)propane and was colored, thus resulting in color images faithful to the manuscript. The highest density of the black of the color image was approximately 1.4 in visual density and base density was approximately 0.07.

COMPARATIVE EXPERIMENT 1

A base sheet paper (manufactured by CCP Jujo Paper Co., Ltd. of Japan) of pressure sensitive paper available on the market was used as the image receiving substrate as in the embodiment 3. It was heated for 210° C. for 5 seconds to reproduce the color image. The highest density of the black at this time was approximately 1.4 in visual density and the base density was approximately 0.16.

EMBODIMENT 4

First, solutions of red, green and blue purple were prepared in accordance with the following prescription.

| Substances | parts by weight |
|---|---|
| (1) Red solution | |
| *Melamine: Sumitex Resin M-3 (name used in trade and manufactured by the Sumitomo Chemical Co., Ltd.) | 100 |
| *Curing accelerator: Sumitex Accelerator EPX (name used in trade and manufactured by the Sumitomo Chemical Co., Ltd.) | 8 |
| *Coloring dye: Methyl Orange | 2 |
| *Coloring dye: Aizen Rose bengal B (name used in trade for C.I. Acid Red 94 and manufactured by Hodogaya Chemical Co., Ltd. of Japan) | 2 |
| Water: | 100 |
| (2) Green solution | |
| *Melamine: Sumitex Resin M-3 | 100 |
| *Curing accelerator: Sumitex Accelerator EPX | 8 |
| *Coloring dye: Suminol levelling yellow NR (C.I. Acid Yellow 19) (manufactured by the Sumitomo Chemical Co., Ltd. of Japan) | 10 |
| *Coloring dye: Kayacion green A-4G (manufactured by the Nippon Chemical Co., Ltd. of Japan) | 7 |
| Water: | 100 |
| (3) Blue purple solution | |
| *Melamine: Sumitex Resin M-3 | 100 |
| *Curing accelerator: Sumitex Accelator EPX | 8 |
| *Coloring dye: Acid Violet 6B (C.I. Acid Violet 49) (manufactured by Hodogaya Chemical Co., Ltd. of Japan) | 1.2 |
| Water: | 100 |

When the solutions of the above-described substances (1) through (3) were granulated respectively by the spray-dry apparatus, light transmitting particles having the color separation function and average particle diameter of 20 μm were provided. The dye former solutions were separately coated in fluid state onto the particles in accordance with the following prescription.

(1) Red particle

The solution 50 parts by weight composed of cyan-color-developing dye former 3,7-bis-diethylamino-10-trichloroacetyl-phenoxazine 10 parts by weight, ethyl cellulose (binding agent) 1 part by weight and dichloroethane (solvent) 89 parts by weight, was coated in fluid state with respect to the red particles 100 parts by weight.

(2) Green particles

A solution 15 parts by weight composed of magenta-color-developed dye former 4-(5-chloro-1,3,3-trimethyl-indolino)methyl-7-(N-methyl-N-phenyl)amino-5'-chloro-1',3',3'-trimethyl-spiro[2H-1-benzopyran-[2H]-indole] 10 parts by weight, ethyl cellulose 1 part by weight, and dichloroethane 89 parts by weight is coated in fluid state with respect to the green particles 100 parts by weight.

(3) Blue purple color-developed particles

A solution 50 parts by weight composed of yellow color-developed dye former N-(1,2-dimethyl-3-yl)-methylidene-2,4-dimethoxy aniline 10 parts by weight, ethyl cellulose 1 part by weight and dichloroethane 89 parts by weight is coated in fluid state with respect to blue purple particles 100 parts by weight.

The colored particles 100 parts by weight obtained as described hereinabove were added to a solution wherein water 90 parts by weight was added to ECR-34 (manufactured by Dow Chemical Co., Ltd. of U.S.A.) of polyelectrolyte quaternary ammonium salt for sufficient mixing. They were separately sprayed and dried for conductive treatment. The specific resistivity of the particles was approximately $10^8\Omega$.cm.

Image forming particles, having a color separation function, separately prepared in the manner as described hereinabove were mixed respectively by equal amount to provide color image forming particles.

One-shot color reproducing method for reproducing the color images with one-time exposure, one-time development, as described hereinafter, was effected with the use of the image forming particles.

As the photoconductive support member, the ordinary panchromated zinc oxide photosensitive plate was employed.

For the image forming method, the photoconductive plate was first negatively charged by a corona charger applied with potentials at −6 through −7 KV in a dark location. Then, the color image forming particles were spread on the photoconductive plate in a dark location. The photoconductive plate was slightly vibrated to remove the excessively attached particles. The particles were electrostatically attached in one layer onto the photoconductive plate. Then a light transmitting color was exposed for about 7 seconds with the use of a tungsten lamp of 500 W. When the photoconductive plate was vibrated after the image exposure, the image forming particles, whose electrostatic attraction with respect to the photoconductive plate was weakened or erased through the exposure, were caused to fall, thus producing the color separated particle images on the photoconductive plate.

White light was projected onto the entire face of the photoconductive plate to optically attenuate the charge of the electrostatic latent images remaining on the photosensitive plate. Thereafter, the particles were transferred onto the bond paper available on the market, and heated at 180° C. for 0.4 second so as to cause the dye former to be evaporated and impregnated in the bond paper.

The particles were removed for cleaning by the ordinary means. Thereafter, the color developing agent was caused to adhere for developing its color as in the embodiment 2, thus reproducing color images faithful to the color manuscript. The highest density of the black of the color images was approximately 1.5 in visual density, and the base density was approximately 0.07.

EMBODIMENT 5

The dye former was evaporated and impregnated in the bond paper and the particles were removed for cleaning as in the embodiment 4. Thereafter, the bond paper was past through a dish filled with a liquid in which colloidal silica snow-tex ST-20 (manufactured by Nissan Chemical Co., Ltd. of Japan) 10 parts by weight was diluted with water 100 parts by weight for developing of color. Upon subsequent air-drying of the paper, color images faithful to the color document were reproduced. The highest density of the black of the color images was approximately 1.5 in visual density, and the base density was approximately 0.08.

COMPARATIVE EXPERIMENT 2

Particle images were produced on the photoconductive plate as in the embodiment 4, and white light was projected onto the entire face of the photoconductive plate. Then, the charge of the electrostatic latent images remaining on the photoconductive plate was optically attenuated, and thereafter, the particles were transferred onto a clay paper (Schilton manufactured by Mitsubishi Paper Mills, Ltd. of Japan) available on the market, with subsequent heating at 210° C. for 5 seconds. The particles were removed for cleaning in the same manner as described hereinabove to reproduce the color images. The highest density at this time was approximately 1.5 in visual density, and the base density was approximately 0.14.

Although the present invention has been described and illustrated in detail, it is to be clearly understood that the same is by way of illustration, the spirit and scope of the present invention being limited by the terms of the appended claims.

What is claimed is:

1. An image forming process comprising a step of arranging on a support member, in accordance with image signals, image forming particles containing a resin and a dye former which develops its color in reaction with a color developing agent; a heat-transfer step of heating said particles to vaporize said dye former thereby to transfer said dye former onto an image receiving substrate; and a step of causing said color developing agent to be applied to said dye former on said image receiving substrate after said heat-transfer step to provide colored images.

2. The image forming process in accordance with claim 1, wherein the image forming particles are arranged in one layer on the support member.

3. The image forming process in accordance with claim 1, wherein the image forming particles are light transmitting particles having a color separation function.

4. The image forming process in accordance with claim 1, wherein the image forming particles are conductive.

5. The image forming process in accordance with claim 1, wherein the support member is dielectric.

6. The image forming process in accordance with claim 1, wherein the support member is a photoconductive member.

7. The image forming process in accordance with claim 1, wherein the support member is an image receiving substrate.

8. The image forming process in accordance with claim 1 further comprising a step of removing for cleaning, the image forming particles from the support member or the image receiving substrate after the heat-transfer step.

9. The image forming process in accordance with claim 1, wherein the color developing agent is an acidic substance.

10. The image forming process in accordance with claim 1, wherein the image receiving substrate is plain paper.

* * * * *